US011659919B2

(12) United States Patent
Stone

(10) Patent No.: US 11,659,919 B2
(45) Date of Patent: May 30, 2023

(54) PORTABLE MASSAGE LOTION WARMER

(71) Applicant: Debora Stone, LaPlata, MD (US)

(72) Inventor: Debora Stone, LaPlata, MD (US)

( * ) Notice: Subject to any disclaimer, the term of this patent is extended or adjusted under 35 U.S.C. 154(b) by 86 days.

(21) Appl. No.: 17/520,863

(22) Filed: Nov. 8, 2021

(65) Prior Publication Data

US 2022/0386766 A1 Dec. 8, 2022

Related U.S. Application Data

(60) Provisional application No. 63/196,972, filed on Jun. 4, 2021.

(51) Int. Cl.

| | |
|---|---|
| ***A45F 3/00*** | (2006.01) |
| ***A45F 5/02*** | (2006.01) |
| ***A45D 34/00*** | (2006.01) |
| ***H05B 3/34*** | (2006.01) |
| *A45F 5/00* | (2006.01) |

(52) U.S. Cl.

CPC ..... *A45F 5/021* (2013.01); *A45D 34/00* (2013.01); *H05B 3/34* (2013.01); *A45D 2200/155* (2013.01); *A45F 2005/002* (2013.01)

(58) Field of Classification Search

CPC ..... F25D 2303/08221; F25D 2331/801; F25D 2331/8015; F25D 3/08; F25D 2303/0841; A45F 3/005; A45F 2200/0583; A45F 3/16; A45F 5/022; A45F 2005/002; A45C 11/20; A45C 13/02; A45C 2011/007; H05B 3/34; H05B 3/342; H05B 3/345; H05B 3/347; H05B 2203/00; H05B 2203/036; A45D 34/00; A45D 2200/155

USPC ..... 224/148.3, 148.4–148.6, 230

See application file for complete search history.

(56) References Cited

U.S. PATENT DOCUMENTS

| | | | | |
|---|---|---|---|---|
| 3,741,376 | A * | 6/1973 | Brown | A45F 5/02 224/183 |
| 5,216,900 | A * | 6/1993 | Jones | F25D 3/08 224/901.2 |
| 6,278,091 | B1 * | 8/2001 | Van Gooden | H05B 3/342 219/535 |
| 2004/0065703 | A1 * | 4/2004 | Bellucci | A45F 3/20 224/660 |
| 2014/0061273 | A1 * | 3/2014 | Bullivant | A45F 3/04 224/576 |
| 2014/0312092 | A1 * | 10/2014 | Waters | A45F 5/021 224/671 |
| 2018/0116361 | A1 * | 5/2018 | Anjum | A45C 5/146 |

(Continued)

*Primary Examiner* — Adam J Waggenspack

(74) *Attorney, Agent, or Firm* — Brennan, Manna & Diamond, LLC

(57) ABSTRACT

The present invention relates to a multipurpose heating and storage device for a lotion bottle. The device comprises a holster that can be secured to a user's waist and a holster insert capable of being placed in the holster. The insert secures the lotion bottle placed therein, and also includes a flexible heating element for providing heat to the lotion bottle and the lotion stored therein. A battery pouch includes a power bank that provides electrical power to the heating element using a USB cable. Due to the heating element, the lotion can be maintained at a desired temperature in order to prevent the application of cold lotion to an individual's body. The holster obviates the need to carry around a lotion bottle.

16 Claims, 6 Drawing Sheets

(56) References Cited

U.S. PATENT DOCUMENTS

| | | | | |
|---|---|---|---|---|
| 2022/0183448 | A1* | 6/2022 | LeDesma | A45F 3/005 |
| 2022/0385111 | A1* | 12/2022 | Truettner | A41D 1/002 |

* cited by examiner

PORTABLE MASSAGE LOTION WARMER

CROSS-REFERENCE TO RELATED APPLICATION

The present application claims priority to, and the benefit of, U.S. Provisional Application No. 63/196,972, which was filed on Jun. 4, 2021 and is incorporated herein by reference in its entirety.

FIELD OF THE INVENTION

The present invention relates generally to the field of lotion bottles storage devices. More specifically, the present invention relates to a lotion bottle storage and warmer device designed as a holster that enables a user to store a lotion bottle in the holster. The device includes an insert with an embedded heating element for heating the lotion stored in the lotion bottle, enabling a user to always retrieve warm lotion or any other topical product. The device includes a holster pouch that stores the lotion bottle, and the insert. The insert circumscribes at least a portion of an outer surface area of the lotion bottle enabling the heating element to warm the lotion to reach a desired warmth level. Further, the device includes a storage space for a power bank that provides electrical power to the heating element. The holster device can be used by a massage practitioner as it eliminates the need to carry around a lotion bottle or store it on a nearby table, thereby avoiding the application of a cold lotion. Accordingly, the present disclosure makes specific reference thereto. Nonetheless, it is to be appreciated that aspects of the present invention are also equally applicable to other like applications, devices and methods of manufacture.

BACKGROUND

By way of background, a topically-applied product can be directly applied to the body's surface (e.g. skin, face) in order to achieve a desired local therapeutic effect. Many product types fall under the umbrella of topical drugs, including lotions, creams, ointments, gels, foams, and drops, etc. Consumers prefer topically-applied products as they are effective, safe and pleasant to use. However, a cold topical product such as a cold moisturizing lotion cannot be applied as effectively on the body, and it also does not leave a smooth effect on the skin. This problem is exacerbated in winter season when such a product solidifies (i.e. viscosity increases) and cannot be applied on the body. The experience of a topical application is enhanced when the topically-applied product is warmed or heated.

When a topical product is slightly warmed or heated, the viscosity is reduced, and the product can be easily applied on the body of a user. Reduced viscosity also enables a thin and uniform layer of the product to be applied to the body. However, current devices and methods can warm a topical product more than desired. Further, the current lotion warmers and other similar devices require a conventional electrical supply, which may not always be accessible to the user. Therefore, people desire a portable topical product warmer that provides a desired heating level of the topical product that can also be activated using a portable power supply.

Usually, for applying a topical product such as a lotion, a massage therapist or practitioner carries a holster around the waist that stores a lotion bottle. The lotion bottle is securely placed, and enables the practitioner to walk around hands-free of the lotion bottle while treating or massaging a client. The therapist can reach the bottle easily, making the process of applying lotion more efficient. However, the lotion stored in the holster can become cold during a long session of therapy or massage, causing difficulties for the therapist in applying the lotion on the body of the client, and diminishing the experience for the client. The therapist may have to repeatedly remove the lotion bottle from the holster and place it in a conventional lotion warmer during the therapy, which breaks the rhythm of the process and also consumes more time. Therefore, therapists desire a holster that can also provide the functionality of a lotion warmer in addition to storage of a lotion bottle.

Also, when the lotion bottle is large, it cannot be carried in conventional holsters. The therapist has to carry the bottle in his or her hands while performing therapy, which is uncomfortable for both the practitioner and the client. Thus, people desire a holster that can carry large lotion bottles.

Therefore, there exists a long felt need in the art for a lotion warmer and storage device that functions like a conventional holster for easy carriage of a lotion bottle around the waist of a user. There is also a long felt need in the art for a lotion warmer and storage device that can heat or warm the lotion as per a user's requirement. Additionally, there is a long felt need in the art for a lotion warmer and storage device that can be used with any type of topical composition or product. Moreover, there is a long felt need in the art for a lotion warmer and storage device that makes it easy for professional therapists or practitioners to carry a lotion bottle and apply warm lotion to the clients. Further, there is a long felt need in the art for a lotion warmer and storage device that makes a lotion bottle easily reachable. Furthermore, there is a long felt need in the art for a lotion warmer and storage device that eliminates the use of an external lotion warmer during a therapy process. Finally, there is a long felt need in the art for a lotion warmer and storage device that ensures users always have a warm lotion bottle stored in the holster storage.

The subject matter disclosed and claimed herein, in one embodiment thereof, comprises a lotion bottle storage and warmer holster device that is designed to be a holster device that conveniently stores a lotion bottle and warms the lotion stored in the lotion bottle. The lotion bottle storage and warmer holster device comprises a holster pouch for storing an insert and the lotion bottle. The insert is constructed of a flexible material and surrounds at least a portion of the lotion bottle within the holster pouch. Also, the insert includes an embedded heating element to heat the lotion bottle in order to warm the lotion stored in the lotion bottle to a desired warmth. The device includes a battery or portable charger holding pouch, positioned at the rear surface of the holster pouch, and is designed to store a power source such as a power bank to provide power to the heating element using a USB cable. Additionally, the holster device comprises an extendable belt fastened to the holster pouch for wrapping around the waist of a user, thereby enabling the user to walk hands-free of the bottle.

In this manner, the lotion bottle holster of the present invention accomplishes all of the forgoing objectives and provides a relatively safe and cost-effective device to store and warm a lotion. The lotion bottle can be easily stored in the holster, thereby enabling a user to access the bottle easily while the heating element provides the desired heating of the lotion using the power bank. The holster eliminates the use of an external lotion warmer and storage device for the lotion bottle.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a lotion bottle storage and warmer holster device. The lotion bottle storage and warmer holster device is designed to be a holster device that conveniently stores a lotion bottle, and warms the lotion stored in the lotion bottle. The lotion bottle storage and warmer holster device further comprises a holster pouch for storing an insert and the lotion bottle, the insert is constructed of a flexible material and surrounds at least a portion of the lotion bottle within the holster pouch, the insert includes an embedded heating element for providing heat to the lotion bottle to warm the lotion stored in the lotion bottle to a desired warmth, a battery pouch positioned at the rear surface of the holster pouch and is designed to store a power source such as a power bank to provide power to the heating element using a USB cable, an extendable belt fastened to the holster pouch for wrapping around a waist of a user, thereby enabling the user to walk hands-free of the bottle. The heating element can be selectively-activated by making the connection with the power bank.

In yet another embodiment, the heating element includes an automatic shut-off feature that automatically shuts-off the heating element after a predetermined and/or selectable time period (i.e. two minutes).

In yet another embodiment of the present invention, the heating element is flexible and can be in the form of grid to circumscribe at least a portion of the stored lotion bottle for heating the lotion in the lotion bottle to reach a desired warmth level or temperature, preferably slightly above the body temperature of a human.

In yet another embodiment of the present invention, a holster device for storing and warming a container storing a lotion is disclosed. The holster device includes a holster pouch for storing the container that contains the lotion, an extendable belt for wrapping around the waist of a user for hands-free storage of the holster device, an insert that includes an embedded heating element, wherein the insert is placed within the holster pouch and circumscribes at least a portion of the outer surface area of the container for providing heat to warm the lotion stored in the container, a battery pouch detachably-attached to the holster pouch for storing a power bank that provides electrical power to the heating element using a coil or a cable, such as a USB cable. The heating element provides heat, thereby enabling the lotion to reach a temperature above the body temperature of a human, while eliminating the need to carry around the container in the hands or store it on a nearby table while giving a massage.

In yet another embodiment of the present invention, the holster pouch can store more than one container or lotion bottle.

In yet another embodiment, the heating element can provide heat to one or more of pastes, gels, tonics, shampoos, conditioners, lotions and the like. Furthermore, the heating element can be used with substances that give off smells, such as those used in aroma therapy, incense-type substances and the like.

In accordance with another embodiment of the present invention, a method is provided for easily applying warm lotion to a body of a user. The method includes the step of wrapping the holster device, designed to store and heat a lotion bottle, around a waist using an extendable belt. Another step in the method is storing a container that has the lotion for application on the user and connecting the heating element that surrounds the container with a power bank using a USB cable. The method eliminates the need to carry around the container or store it on a nearby table while giving a massage. The method further prevents the application of cold lotion to the user's body.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
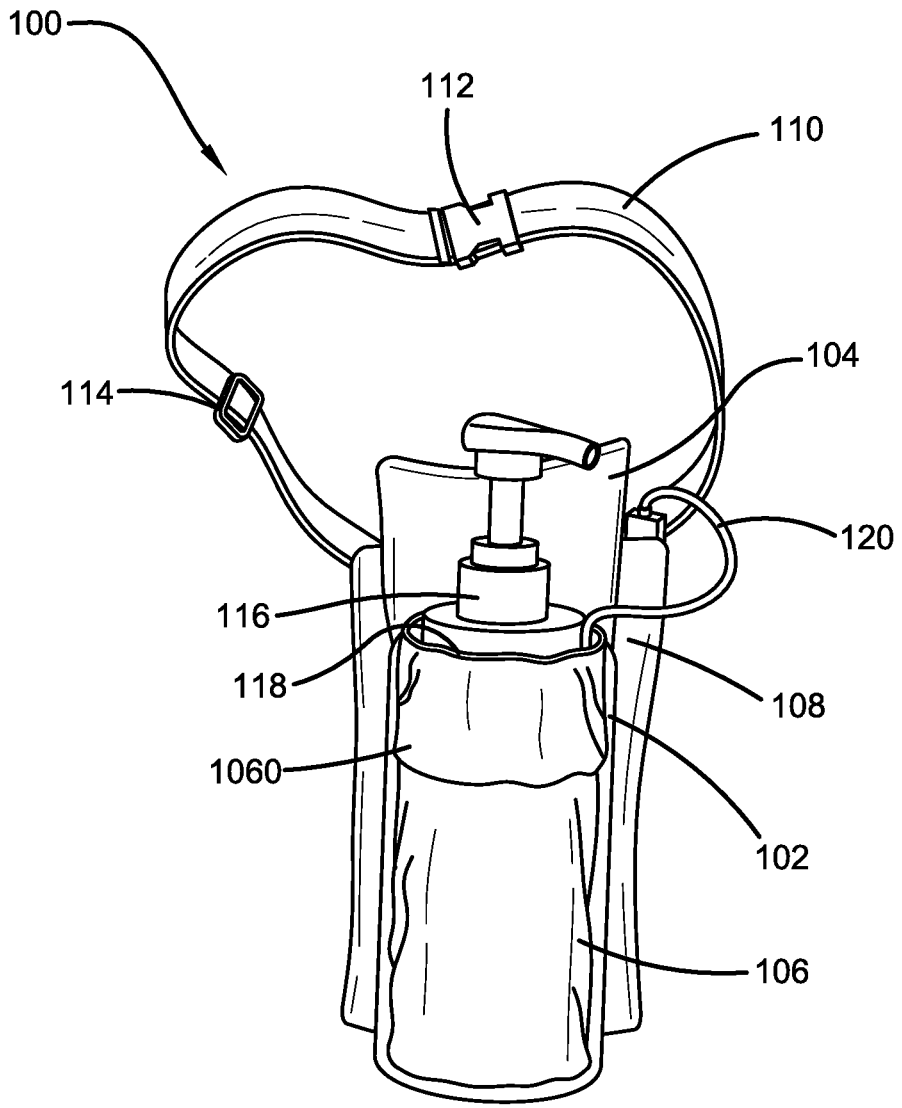
FIG. 1 illustrates a perspective view of one potential embodiment of the lotion bottle storage and warmer device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown.

Thus, in other embodiments, any of the features described herein from different embodiments may be combined.

As noted above, there exists a long felt need in the art for a lotion warmer and storage device that functions like a conventional holster for easy carriage of a lotion bottle around the waist of a user. There is also a long felt need in the art for a lotion warmer and storage device that can heat or warm the lotion as per a user's requirement. Additionally, there is a long felt need in the art for a lotion warmer and storage device that can be used with any type of topical composition or product. Moreover, there is a long felt need in the art for a lotion warmer and storage device that makes it easy for professional therapists or practitioners to carry a lotion bottle and apply warm lotion to the clients. Further, there is a long felt need in the art for a lotion warmer and storage device that makes a lotion bottle easily reachable. Furthermore, there is a long felt need in the art for a lotion warmer and storage device that eliminates the use of an external lotion warmer during a therapy process. Finally, there is a long felt need in the art for a lotion warmer and storage device that helps users to always have warm lotion carried in the holster storage.

The present invention, in one potential embodiment, includes a novel holster device for storing and warming a container storing a lotion. The holster device includes a holster pouch for storing the container that contains the lotion, an extendable belt for wrapping around a waist of a user for hands-free storage of the holster device, an insert that includes an embedded heating element wherein the insert is placed within the holster pouch and circumscribes a majority of the surface area of the container for providing heat to warm the lotion stored in the container, a battery pouch detachably-attached to the holster pouch for storing a power bank that provides electrical power to the heating element using a coil or cable, such as a USB cable. The heating element enables the heating of the lotion to reach a temperature above the body temperature of a human, while eliminating the need to carry around the container in one's hands or store it on a nearby table while giving a massage.

Referring initially to the drawings, FIG. 1 illustrates a perspective view of one potential embodiment of the lotion bottle storage and warmer device of the present invention in accordance with the disclosed architecture. The lotion bottle storage and warming device 100 of the present invention includes a holster 102 for accommodating a lotion bottle 116. The holster 102 is designed to be wrapped around the waist of a user for easily carrying the lotion bottle 116. An extendable belt 110 having a buckle 112 is fastened to the holster 102 and is used for securing the holster 102 around the waist of the user. The belt 110 can be extended using a loop 114 to fit snugly around the waist of the user. The holster 102 is in the form of a pouch and includes an opening 118 through which the lotion bottle 116 can be inserted. A lotion bottle 116 up to a size of about 16 oz. can be stored in the holster pouch 102.

Figure 3:
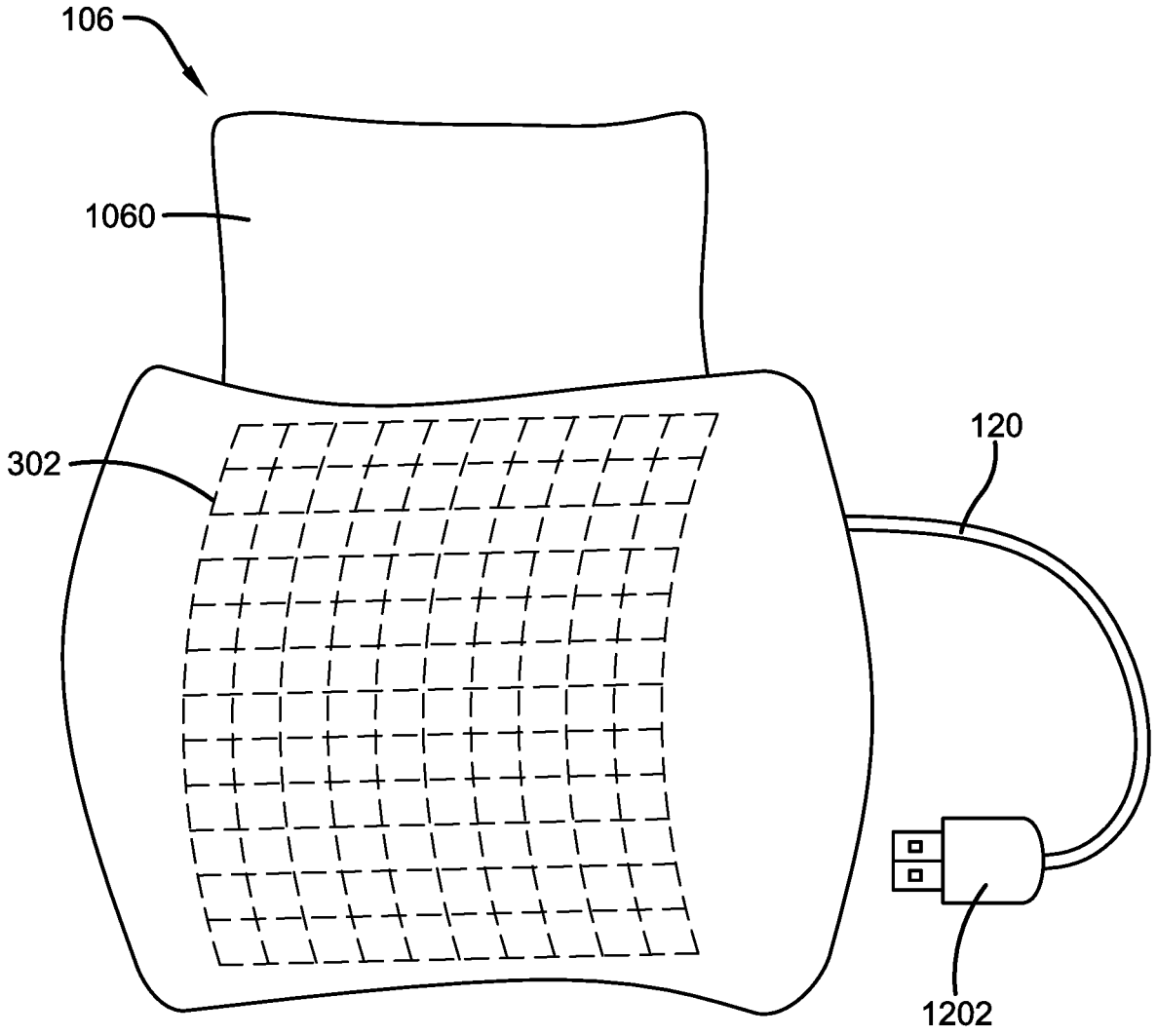
FIG. 3 illustrates a perspective view of the insert with embedded heating element used in one potential embodiment of the lotion bottle holster device of the present invention in accordance with the disclosed architecture.

The lotion bottle storage and warming device 100 includes an insert 106 that is placed in the holster pouch 102. The lotion bottle 116 in the holster pouch 102 can be secured by the insert 106. Preferably, the insert 106 adheres to or aligns with the inner surface of the holster pouch 102, and a flap 1060 of the insert 106 can be accessible from outside. The insert 106 can be in the form of a fabric and includes an embedded heating element (as shown in FIG. 3) for warming the lotion stored in the lotion bottle 116. The heating element can be in the form of a flexible heating pad, wrap, coil or plate that can be activated by a power supply such as from a power bank stored in the battery pouch 108 using a USB charging cable 120. The heating pad or wrap of the insert 106 can be embedded within the insert 106, thereby enabling it to be in physical contact with the lotion bottle 116. The insert 106 is capable of securing and warming lotion in the lotion bottle 116 made from glass, plastic, wood or the like. The USB cable 120 can be inserted into the holster pouch 102 through the opening 118, and can be connected to the insert 106 stored inside the holster pouch 102 for activating the heating element.

When the lotion bottle 116 is to be used by a user, the cover or lid 104 of the holster pouch 102 can be removed, thereby enabling the user to access the lotion bottle. The lid 104 is provided to selectively secure the lotion bottle 116 between uses. The battery pouch 108 can be attached or fastened to the rear surface of the holster pouch 102 and is used to store a power bank for providing power to the heating element for activation. The power bank can be any conventional power bank that works with the USB cable 120 for activating the heating element of the insert 106. The USB cable 120 can be inserted into the battery pouch 108 through the battery pouch opening 122 that also enables a user to access the stored power bank.

The lotion bottle storage and warming device 100 enables a user to carry the lotion bottle 116 in the holster pouch 102 easily around the waist, while the insert 106 provides desired heating to the lotion for enhanced performance of the lotion stored in the bottle 116. The desired heating can be achieved using the power bank stored in the battery pouch 108 by connecting the USB cable 120 from the power bank to the insert 106 of the device 100. The insert 106 can be detachably-placed in the holster pouch 102, and the battery pouch 108 can also be detachably-attached to the holster pouch 102.

The lotion bottle storage and warming device 100 is ideal for massage therapists and practitioners who need to carry a lotion bottle 116 continuously for longer treatment or therapy sessions, and who have a requirement to apply warm lotion or any other topical product to the body of a client. The heating element in the insert 106 can be easily activated using the power bank to reach a desired temperature that enables the warm lotion to be easily applied.

Figure 2:
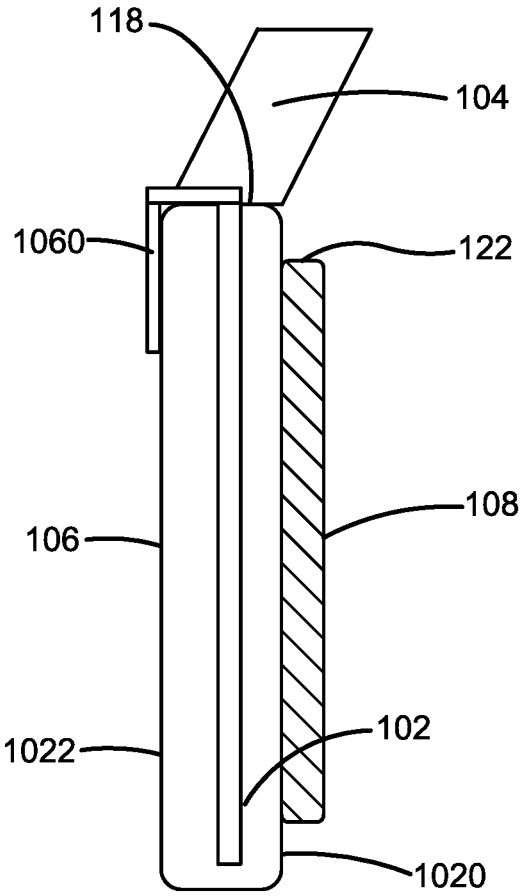
FIG. 2 illustrates a side view of one potential embodiment of the lotion bottle storage and warming device of the present invention in accordance with the disclosed architecture.

FIG. 2 illustrates a side view of the lotion bottle storage and warming device 100 of the present invention in accordance with the disclosed ouches. The lotion bottle storage and warming device 100 comprises a three-layer holster device that includes the insert 106 placed inside the holster pouch 102, with a flap 1060 of the insert 106 overhanging a top edge of the holster pouch 102 and contacting the front surface 1022 of the holster pouch 102. The overhanging flap 1060 of the insert enables the insert 106 to retain its position within the holster pouch 102. The insert 106 can be stored within the holster pouch 102, such that the embedded heating element of the insert 106 contacts the lotion bottle placed in the holster pouch 102 for warming the stored lotion therein. At the rear surface 1020 of the holster pouch 102, the battery pouch 108 is fastened using an adhesive or hook and loop fastener, through a magnetic or snap button or detachably-fastened using straps. The holster 102 includes a lid or cover 104 for securing the lotion bottle stored in the holster pouch 102 when the bottle is not being used.

It should be appreciated that the opening 118 of the holster pouch 102 enables the user to easily access the lotion bottle and any type of lotion bottle can be used with the holster pouch 102. Further, the battery pouch opening 122 enables the USB cable to be easily inserted for making a connection with the stored power bank.

FIG. 3 illustrates a perspective view showing the insert 106 with embedded heating element 302 used in the lotion bottle holster device 100 of the present invention in accordance with the disclosed architecture. The insert 106 provides the necessary heating to the lotion stored in the lotion bottle when the insert 106 is placed in the holster pouch. Specifically, the commercially-available lotion bottle holster device 100 of the present invention, the insert 106 can be permanently placed and sewn to the interior of the pouch 102, thereby enabling the insert 106 to contact the lotion bottle. The insert 106 includes an embedded heating element 302 in the form of a grid of flexible conducting metal wires, pads or plates that conform to the circular or tubular shape of the holster pouch. When a lotion bottle is stored in the holster pouch, the embedded heating element 302 provides heat to the lotion stored in the lotion bottle to warm the lotion for use. For heating the heating element wire grid 302, a USB cable 120 can be used that includes a USB charging connector 1202 designed to be connected to a power bank for providing electrical power to the heating element wire grid 302 for heating the lotion. In this manner, based on the requirements, the heating element 302 can be heated and a warm lotion produced for massage or therapy.

The heating element 302 uses minimal electrical power and provides a heating source that can keep gels, oils, lotions and creams selectively above human body temperature. The lotion warmed caused by the heating element 302 improves hydration, as the warm lotion can easily penetrate or permeate into the skin. In one potential embodiment, the heating element 302 can take 2-3 minutes to warm the lotion to reach a desired temperature level. The heating element 302 can also include an automatic shut-off feature that shuts off the heating element 302 after a predeterminable period of time (i.e. twenty minutes). The design and shape of the heating element 302 and the insert 106 (i.e. circumscription of a lotion bottle) enables the lotion to be warmed, even when a small quantity of the lotion is available in the lotion bottle.

Figure 4:
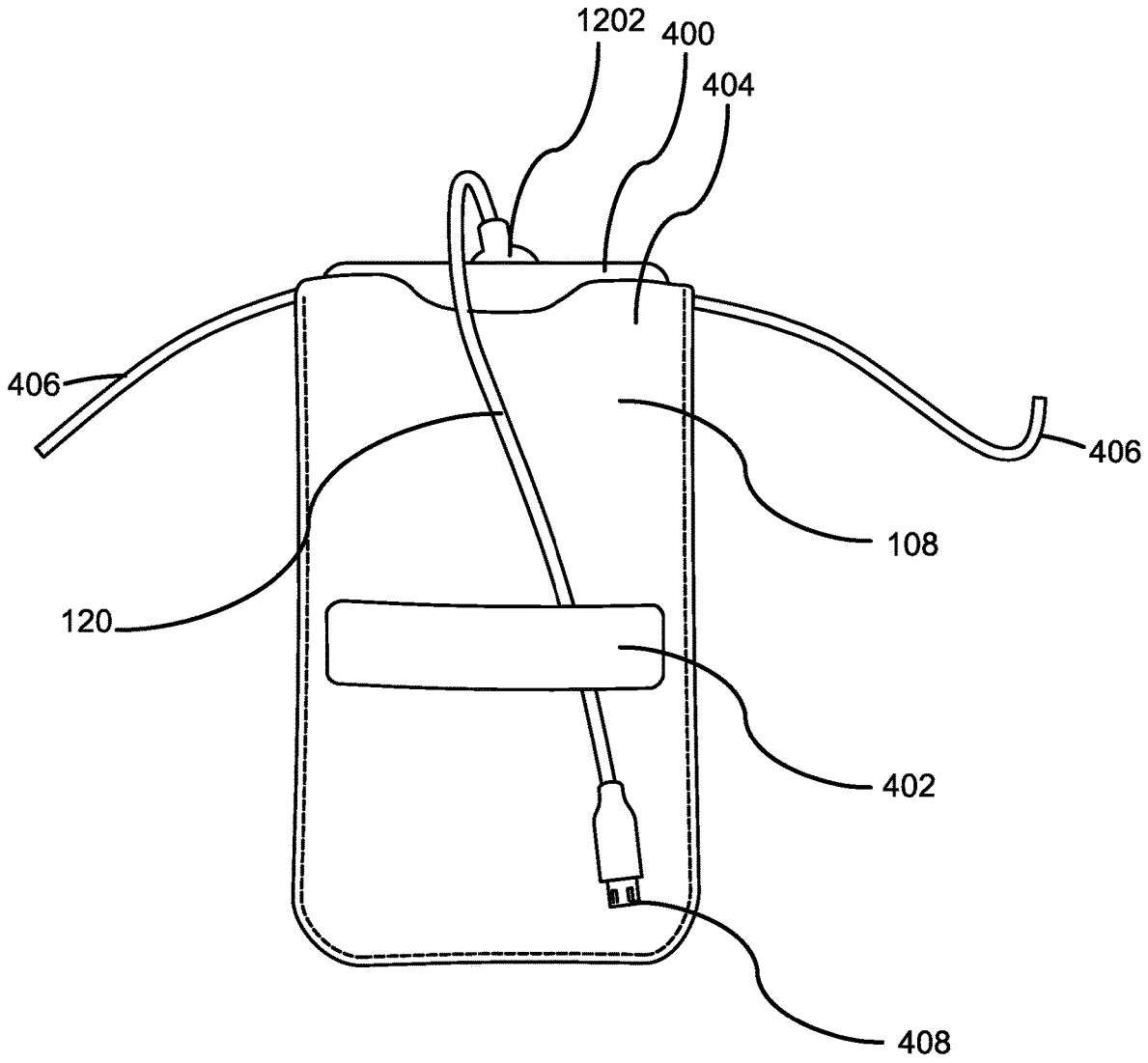
FIG. 4 illustrates a perspective view showing a battery pouch for storing a power bank used for providing power to a heating element of the insert of one potential embodiment of the lotion bottle holster device of the present invention in accordance with the disclosed architecture.

FIG. 4 illustrates a perspective view showing the battery pouch 108 for storing a power bank 400 used for providing power to the heating element of the insert 106 of the lotion bottle holster device 100 of the present invention in accordance with the disclosed architecture. The power bank 400 is stored securely in the battery pouch 108 that can be attached to the rear surface of the holster pouch. As shown, a hook and loop patch 402 can be used to attach the battery pouch 108 to the holster pouch. The hook and loop patch 402 is waterproof and can secure the power bank 400. Alternatively, the straps 406 can be used for fastening the battery pouch 108 to the holster pouch or to the extendable belt. The USB charging connector 1202 can be inserted into the USB charging port of the power bank 400, while the other end 408 can be connected to the heating element of the insert for providing power. A flap 404 can be used for covering and protecting the power bank 400 from water or any other physical damage. It should be appreciated that in the construction of the holster device 100 of the present invention, the battery pouch 108 can be permanently sewn to the holster pouch. The battery pouch 108 can be made from a material including leather, any fabric or any other similar flexible and lightweight material.

Figure 5:
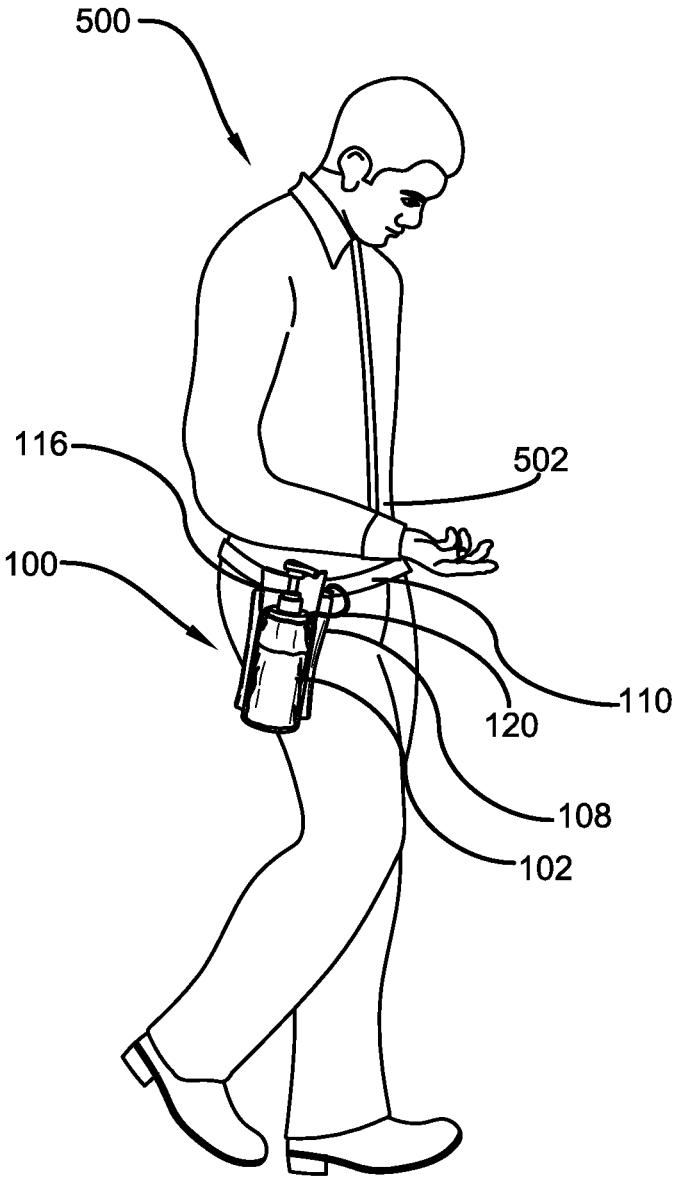
FIG. 5 illustrates a perspective view of a user carrying one potential embodiment of the lotion bottle in the holster device of the present invention in accordance with the disclosed architecture.

FIG. 5 illustrates a perspective view of a user carrying a lotion bottle in the holster device 100 of the present invention in accordance with the disclosed architecture. As shown, a user 500, such as a therapy practitioner, can wrap the holster device 100 around the waist 502 using the extendable belt 110. The lotion bottle 116 stored in the holster pouch 102 can be heated by the insert 106 placed inside the holster pouch 102, and the power bank for charging the heating element of the insert can be stored in the battery pouch 108. Thus, each time lotion is retrieved from the lotion bottle 116, the lotion can be retained in an elevated temperature, rather than being cold due to being left out in the open or on a table. Further, the holster pouch 102 enables the lotion bottle to be opened, dispensed and closed conveniently at hand for desired application. The holster device 100 also obviates the need to carry around the lotion bottle 116 or store the lotion bottle 116 on a nearby table.

Figure 6:
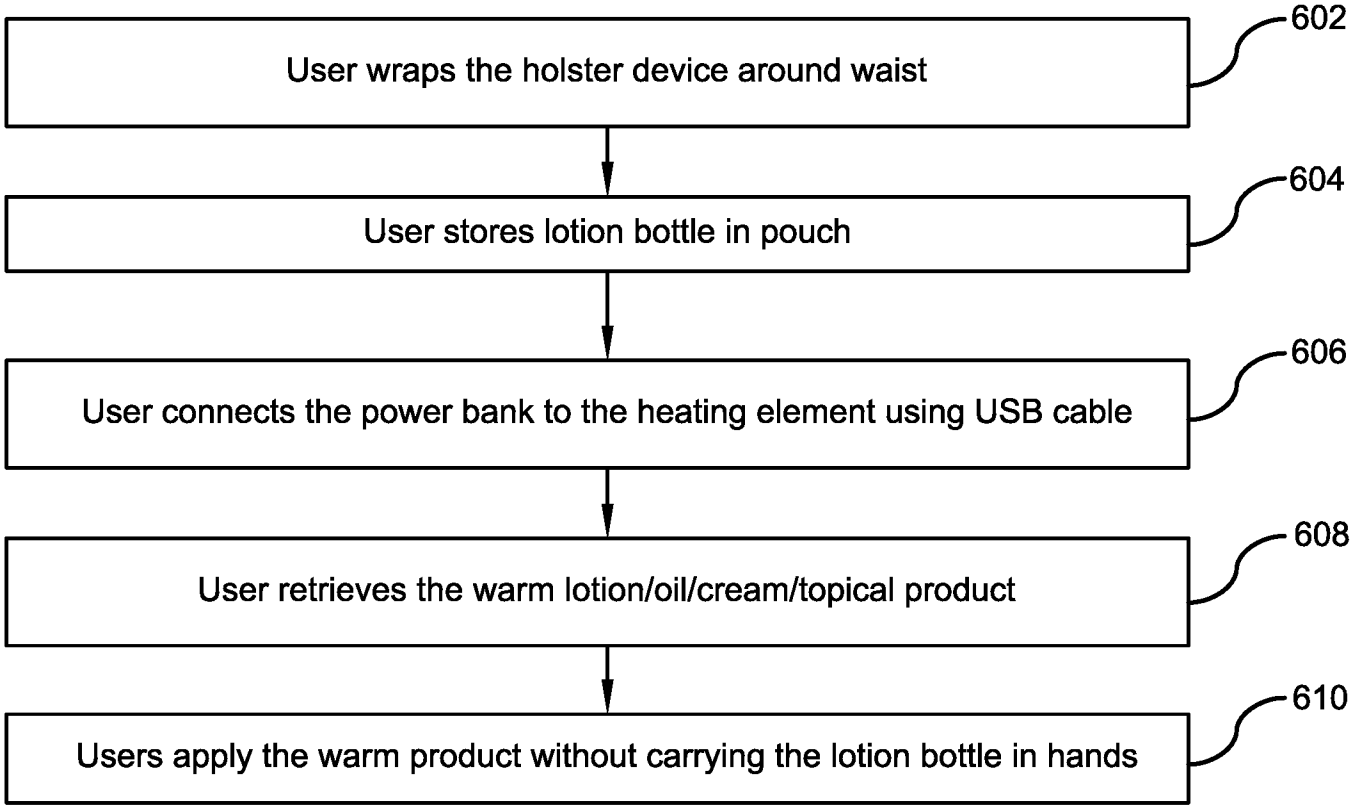
FIG. 6 illustrates a flow diagram showing steps performed by a user for using the holster device of the present invention in accordance with the disclosed architecture.

FIG. 6 illustrates a flow diagram showing steps performed by a user for using the holster device 100 of the present invention in accordance with the disclosed architecture. As shown, initially a user wraps the holster device around the waist using the extendable belt (Block 602). The belt can be extended or retracted using a loop disposed on the belt. Then, the user stores a desired lotion bottle in the holster pouch for massaging/application (Block 604). Thereafter, the user connects the power bank stored in the pouch bag to the heating element embedded in the insert using the USB cable (Block 606). After a few minutes, the user can retrieve the warm lotion/oil/cream/topical product from the lotion bottle (Block 608), and apply same to the body of a client who is being treated by the user, without uncomfortably carrying the lotion bottle in the hands of the user (Block 610).

Although the preferred embodiments describe the holster device 100 for holding containers of lotions, creams and liquids, the holster device 100 can also hold other types of substances such as, but not limited to, pastes, gels, tonics, shampoos, conditioners and the like. Furthermore, the holster device 100 can hold substances that give off smells, such as those used in aroma therapy, incense-type substances and the like.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "lotion bottle holster device", "lotion bottle storage and warmer device", and "holster device" are interchangeable and refer to the lotion bottle storage and warming device 100 of the present invention.

Notwithstanding the forgoing, the lotion bottle storage and warming device 100 of the present invention can be of any suitable size and configuration as is known in the art without affecting the overall concept of the invention, provided that it accomplishes the above-stated objectives. One of ordinary skill in the art will appreciate that the size, configuration and material of the lotion bottle storage and warming device 100 as shown in the FIGS. are for illustrative purposes only, and that many other sizes and shapes of the lotion bottle storage and warming device 100 are well within the scope of the present disclosure. Although the dimensions of the lotion bottle storage and warming device 100 are important design parameters for user convenience, the lotion bottle storage and warming device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A lotion bottle storage and warming device comprising:

a holster including a pouch having an opening for accommodating the lotion bottle;

an extendable belt fastened to said holster for securing around a waist of a user;

a flexible insert including an embedded heating element for placement inside said holster;

said flexible insert aligned with an inner surface of said holster for circumscribing a portion of an outer surface area of the lotion bottle placed therein; and a power bank for powering said heating element wherein said heating element includes a flexible heating coil; wherein said holster incudes a pouch opening for retaining said power bank; and wherein said flexible insert includes a flap overhanging a top edge of said holster for retention of said flexible insert within said pouch of said holster.

2. The lotion bottle storage and warming device of claim 1, wherein said portion of an outer surface area includes a majority of the outer surface area of the lotion bottle.

3. The lotion bottle storage and warming device of claim 2, wherein said heating element includes a flexible heating pad.

4. The lotion bottle storage and warming device of claim 1, wherein said power bank includes a USB connector for recharging said power bank.

5. The lotion bottle storage and warming device of claim 4, wherein said extendable belt includes a hook and loop fastener for securing around the waist of the user.

6. A lotion bottle storage and warming device comprising:

a holster including a pouch having an opening for accommodating the lotion bottle;

an extendable belt fastened to said holster for securing around a waist of a user;

a flexible insert including an embedded heating element for placement inside said holster;

said flexible insert aligned with an inner surface of said holster for circumscribing a portion of an outer surface area of the lotion bottle placed therein;

a rechargeable power bank for powering said heating element;

said heating element includes a flexible heating coil; and said power bank includes a USB connector for recharging said power bank wherein said flexible insert includes a flap overhanging a top edge of said holster for retention of said flexible insert within said pouch of said holster.

7. The lotion bottle storage and warming device of claim 6, wherein said portion of an outer surface area includes a majority of the outer surface area of the lotion bottle.

8. The lotion bottle storage and warming device of claim 7, wherein said holster incudes a pouch opening for retaining said power bank.

9. The lotion bottle storage and warming device of claim 8, wherein said extendable belt includes a hook and loop fastener for securing around the waist of the user.

10. A lotion bottle storage and warming device comprising:

a holster including a pouch having an opening for accommodating the lotion bottle;

an extendable belt fastened to said holster for securing around a waist of a user;

a flexible insert including an embedded heating element for placement inside said holster;

said flexible insert aligned with an inner surface of said holster for circumscribing a portion of an outer surface area of the lotion bottle placed therein;

a rechargeable power bank for powering said heating element;

said heating element includes a flexible heating coil; and said flexible insert includes a flap overhanging a top edge of said holster for retention of said flexible insert within said pouch of said holster.

11. The lotion bottle storage and warming device of claim 10, wherein said power bank includes a USB connector for recharging said power bank.

12. The lotion bottle storage and warming device of claim 11 further comprising a USB charging cable for recharging said power bank.

13. The lotion bottle storage and warming device of claim 10, wherein said portion of an outer surface area includes a majority of the outer surface area of the lotion bottle.

14. The lotion bottle storage and warming device of claim 10, wherein said holster incudes a pouch opening for retaining said power bank.

15. The lotion bottle storage and warming device of claim 10, wherein said extendable belt includes a hook and loop fastener for securing around the waist of the user.

16. The lotion bottle storage and warming device of claim 10, wherein said portion of an outer surface area includes substantially all of the outer surface area of the lotion bottle.

* * * * *